US005174082A

United States Patent [19]

Martin et al.

[11] Patent Number: 5,174,082

[45] Date of Patent: Dec. 29, 1992

[54] ANTI-SEISMIC SHIELDS

[75] Inventors: André P. Martin, Toulon; Minh P. Luong, Paris; Pierre A. Habib, Vigneux S/Seine, all of France

[73] Assignee: Technologies Speciales Ingenierie, Toulon, France

[21] Appl. No.: 676,289

[22] Filed: Mar. 28, 1991

[30] Foreign Application Priority Data

Mar. 30, 1990 [FR] France ..... 90 04560

[51] Int. Cl.[5] ..... E02D 27/34

[52] U.S. Cl. ..... 52/167 DF

[58] Field of Search ..... 52/167 DF, 167 R

[56] References Cited

U.S. PATENT DOCUMENTS 4,484,423 9/1978 McClure, Jr. .

FOREIGN PATENT DOCUMENTS 2622909 5/1989 France .
623923 9/1978 U.S.S.R. ..... 52/167 DF
1030496 7/1983 U.S.S.R. ..... 52/167 DF

OTHER PUBLICATIONS

Patent Abstracts of Japan—vol. 10. No. 257(M-513) (2313) Sep. 3, 1986, and JP-A-61 83711 (Ozawa Concrete Kokgyo K.K.) Apr. 28, 1986.

Patent Abstracts of Japan, vol. 9 No. 307(M-435)(2030) Dec. 4, 1985 and JP-A-60 14412 (Takechi Koumushiyo K.K.) Jul. 30, 1985.

Japan Abstracts of Japan, vol. 8, No. 180(M—318)(1617) 18 Aout 1984, and JP-A-59 72326 (Kumagaigumi KK) Apr. 24, 1984.

*Primary Examiner*—Richard E. Chilcot, Jr.
*Attorney, Agent, or Firm*—Dvorak and Traub

[57] ABSTRACT

This invention relates to shields for protecting a civil engineering work from the destructive effects of earthquakes. A shield according to the invention comprises a plurality of individual islands which are implanted in the ground around the work to be protected and which present mechanical properties different from those of the ground in order to attenuate the seismic surface waves. The islands may be masses of ground compressed between an anchoring means driving in the ground and a sole placed on the ground and connected to the anchoring means by a connecting means under tension. The islands may also be bores or wells filled with granular or pulverulent materials. One application of the invention is the protection of industrial plants or dwellings in order to avoid destruction thereof by earthquakes.

8 Claims, 3 Drawing Sheets

ANTI-SEISMIC SHIELDS

FIELD OF THE INVENTION

The present invention relates to anti-seismic shields adapted to protect civil engineering works, such as dwellings, industrial plants, bridges, barrages, etc. . . . from the destructive effects of earthquakes.

BACKGROUND OF THE INVENTION

The behaviour of a seismic wave is known to depend a great deal on the nature of the sites in which it propagates, particularly on the mechanical properties thereof.

It is known that deteriorations of civil engineering works are generally caused by the horizontal shears due to the surface wave, known as Rayleigh wave, of which the effects may be translated by caving-in or liquefaction of the ground.

Studies that have been able to be made on the effects of numerous earthquakes confirm that the mechanical properties of the surface layer of the earth, i.e. of the layer which extends down to about 30 m in depth, may considerably modify the effects associated with the surface propagation of the seismic wave, although the latter often originates at great depth.

It is an object of the present invention to provide means disposed around the civil engineering works, in order locally to modify the effect of site and to attenuate the surface wave in order to protect these works from the destructive effects of earthquakes.

SUMMARY OF THE INVENTION

The object of the invention is attained by means of individual islands are implanted in the ground, around a work to be protected from earthquakes, which present mechanical properties different from those of the ground in order to attenuate the seismic surface waves The islands may present a rigidity greater than or less than that of the ground.

Both masses having a rigidity greater than that of the ground and islands having a cohesion less than that of the ground, are advantageously implanted in the ground around the work to be protected.

According to a preferred embodiment, each individual island comprises a mass of ground compressed between an anchorage which is driven in the ground at a depth of between 5 m and 30 m and a sole which is placed on the ground and which is connected to said anchorage by a connecting means under tension.

According to a variant embodiment, a seismic shield according to the invention comprises vertical bores or wells presenting a height of between 5 m and 30 m and a diameter of between 30 cm and 1 m, which contain a piping made of an elastomeric or visco-elastic material filled with a granular or pulverulent material.

According to another variant embodiment, a seismic shield according to the invention comprises vertical bores or wells which are filled with tires, themselves filled with a granular or pulverulent material.

The invention results in seismic shields which attenuate the surface waves produced by an earthquake.

The discontinuities of the mechanical properties of the ground due to the compressed masses or to the islands filled with granular or pulverulent materials which are distributed around the work to be protected, have for their effect to modify and alter the propagation of the surface waves which may be sufficiently attenuated for the works to withstand the earthquake.

The discontinuous structure of the shields according to the invention which are composed of individual masses or islands, provides efficient protection of a work for a relatively low cost. Masses of compressed ground obtained by compressing a column of ground between an anchorage driven in the ground and a slab placed on the ground and connected to the anchorage by a cable or a rod under tension, have been described in a prior Patent Application FR-A-2 622 909 which discloses the use thereof for constituting the foundations of a work.

The processes according to the present invention constitute a novel application of these masses of compressed ground, which does not follow obviously from the teachings of the prior art.

These masses of compressed ground are relatively inexpensive to construct in loose or relatively consolidated terrains in which the anchoring means is driven in by beating.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
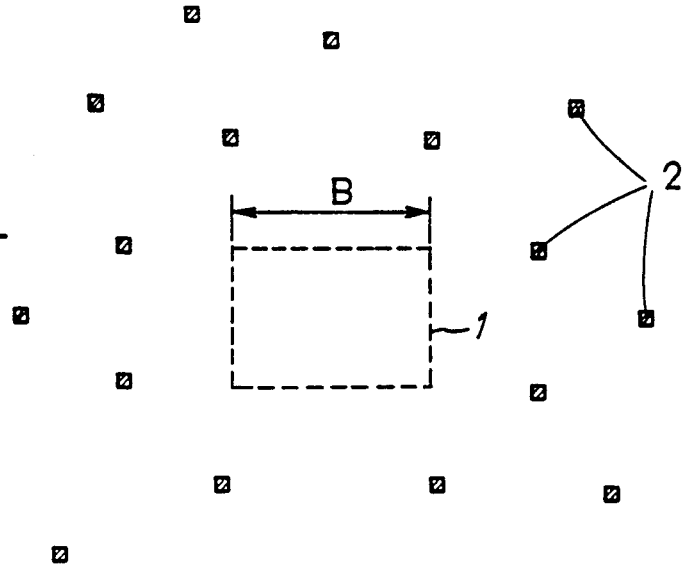
FIG. 1 is a general plan view of an embodiment of a seismic shield protecting a civil engineering work.

Referring now to the drawings, FIG. 1 shows a perimeter 1 surrounding the foundations of a civil engineering work, which may for example be a building or group of buildings, a sensitive industrial plant such as for example a nuclear power plant, a bridge, etc. . . . The largest width of the work is equal to B.

The work lies on foundations anchored in the ground to withstand the loads of the work.

The ground may be of any nature.

An anti-seismic device according to the invention is constituted by a shield disposed around the foundations of the work, which shield is constituted by islands or masses 2 which form a cloud of dots distributed around the work. Each of the dots 2 comprises means which will be described hereinafter and which locally modify the mechanical properties of the ground and which create individual islands or masses having mechanical properties different from those of the ground in which they are incorporated.

The individual islands or masses 2 may comprise means which create a localized zone having a rigidity greater than that of the ground. They may also comprise means which create a localized zone having a cohesion less than that of the ground.

According to a preferred embodiment, there are disposed around the work 1 to be protected, both masses or islands having a rigidity greater than that of the ground and masses or islands having a cohesion less than that of the ground.

The masses or islands 2 may be placed around the work 1 in a geometrical arrangement, for example in concentric circles or in star form or at the apices of regular polygons, in comb-form, quincunx, etc..

They may equally well be disposed at random.

The depth of each island or mass varies at random between 5 m and 30 m, i.e. the heights of the islands or masses constituting the same shield range between 5 m and 30 m.

The distance between two adjacent masses or islands is included between 3 times and 5 times the greatest width of each island or mass.

The islands or masses 2 modify the mechanical properties of the surface layer in which the surface waves propagate consecutive to an earthquake, and such modification causes a modification in the effect of site, i.e. in the mechanical behaviour of the site on which a civil engineering work is built. On condition that the number of islands is sufficient and that they are judiciously distributed around the work, they form a shield which attenuates the amplitudes and accelerations due to the surface waves and which reduces or eliminates the destructive effects of said waves.

The islands or masses 2 are discontinuous, i.e. each occupies a small surface and is separate from the adjacent islands, which differentiates them from linear obstacles such as, for example, walls.

Figure 2:
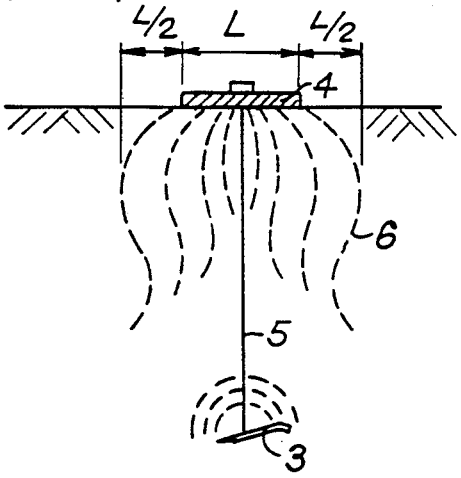
FIG. 2 is a vertical section through a mass of compressed ground.

FIG. 2 is a schematic vertical section through a first embodiment of a pre-stressed mass having a rigidity greater than that of the ground.

This mass is formed in accordance with the process described in FR-A-2 622 909 (TECHNOLOGIES SPECIALES INGENIERIE T.S.I.) and will not be described in greater detail. It will merely be recalled that such a mass comprises an anchoring means 3 which is driven in the ground, a sole 4 which is placed on the ground and a connecting means 5, for example a steel cable or rod which connects the anchoring means to the sole and which is pre-stressed so that the portion of ground included between the sole 4 and the anchoring means 3 is compressed and therefore presents a rigidity greater than that of the surrounding ground.

The broken lines 6 shown in FIGS. 2 to 5 schematically represent the contour of the compressed zones.

If L is the largest dimension of the sole, the compressed zone projects substantially by a width equal to L/2 all around the sole.

Figure 3:
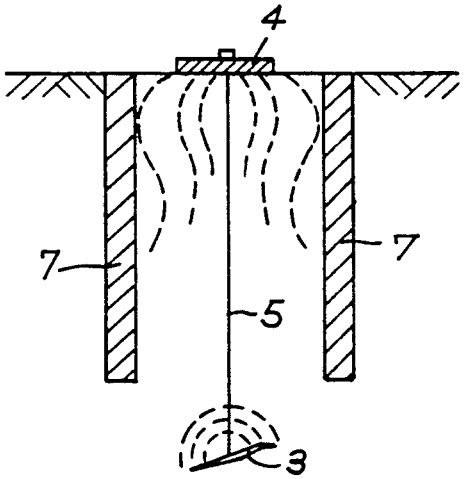
FIG. 3 is a vertical section through an island comprising a compressed mass located between two cast walls.

FIG. 3 is a schematic vertical section through a variant embodiment of a pre-stressed mass. Like elements are designated in FIGS. 2 and 3 by like reference numerals.

The embodiment of FIG. 3 further comprises two cast walls 7 disposed on either side of the anchoring means. For example, walls 7 are walls of concrete which is cast in trenches dug in the ground.

Localized masses may also be constructed, having a rigidity greater than that of the surrounding ground, by compacting the ground between two cast walls.

Figure 4:
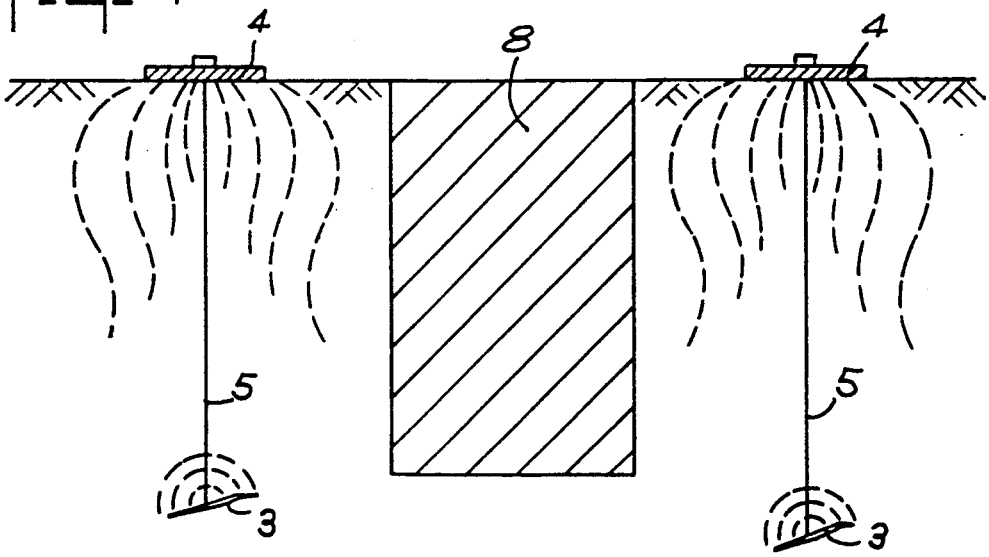
FIG. 4 is a vertical section through a portion of shield comprising a block of concrete placed between two compressed masses.

FIG. 4 shows another embodiment of localized masses having a rigidity greater than that of the surrounding ground. According to this embodiment, a block of concrete 8 is cast in the ground between two pre-stressed masses.

Figure 5:
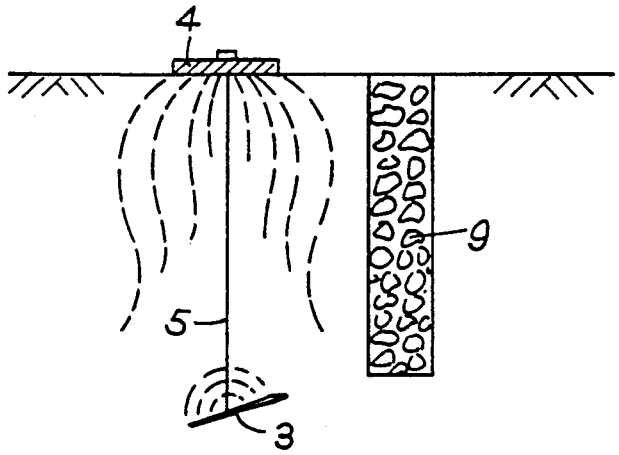
FIG. 5 is a vertical section through a portion of shield comprising a compressed mass and a vertical well filled with stacked rocks or blocks.

FIG. 5 shows another embodiment of an island having mechanical properties different from those of the ground. This island comprises a pre-stressed mass 3.4.5 similar to that of FIG. 2. It further comprises a piled rock unit 9 located beyond the compressed zone. Unit 9 is made by digging in the ground a trench or wells and filling them with blocks of rock which are packed in order to increase their cohesion.

The embodiments shown in FIGS. 2 to 5 enable localized islands to be created in the ground which present a rigidity greater than that of the surrounding ground.

The anchoring means 3 are placed at a depth which varies at random between 5 m and 30 m.

The distance between the masses constituting the same shield is of the order of 3 to 5 times the greatest width L of the sole 4.

The cast walls 7, associated with a pre-stressed mass, have a height equal to or less than the height of this mass.

Figure 6:
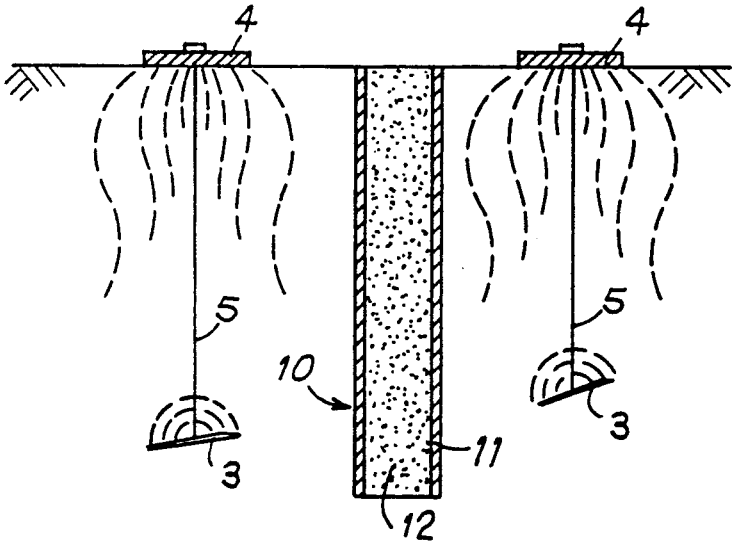
FIG. 6 is a partial vertical section of an embodiment of a shield according to the invention.

FIG. 6 shows another embodiment of islands presenting mechanical properties different from those of the ground.

This Figure shows two pre-stressed masses 3.4.5 identical to the mass shown in FIG. 2.

FIG. 6 further shows an island 10 which comprises a vertical bore having a diameter of between 30 cm and 1 m and a depth of between 5 m and 30 m.

This bore comprises a piping 11 made of an elastomeric or visco-elastic material which is filled with a granular, pulverulent or fragmentary material 12 having mechanical properties very different from those of the ground. For example, in consolidated or clayey terrains, the material 12 is sand, gravel or glass microballs. An island 10, having a high void index which is composed of grains with no cohesion with one another, is thus obtained.

Figure 7:
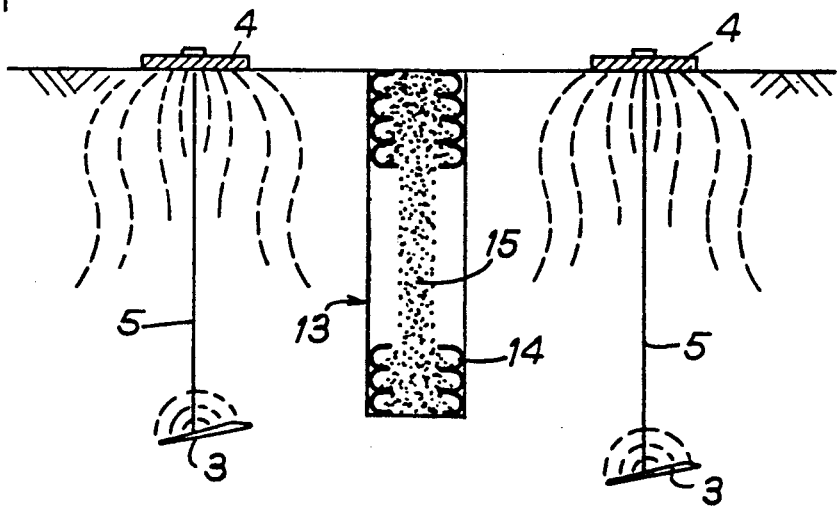
FIG. 7 is a partial vertical section of another embodiment of a shield according to the invention.

FIG. 7 shows another embodiment of islands having mechanical properties different from those of the ground.

FIG. 7 shows two pre-stressed masses 3.4.5 identical to the mass of FIG. 2.

It further shows an island 13 which is constituted by a well dug out vertically in the ground. This well has a diameter greater than the diameter of a tire. It is filled with worn-out tires 14 which are piled on one another.

These tires define an axial channel which is filled with a granular or pulverulent material 15, for example grains of expanded clay, glass micro-balls, sand or gravel, which creep inside the tires.

Figure 8:
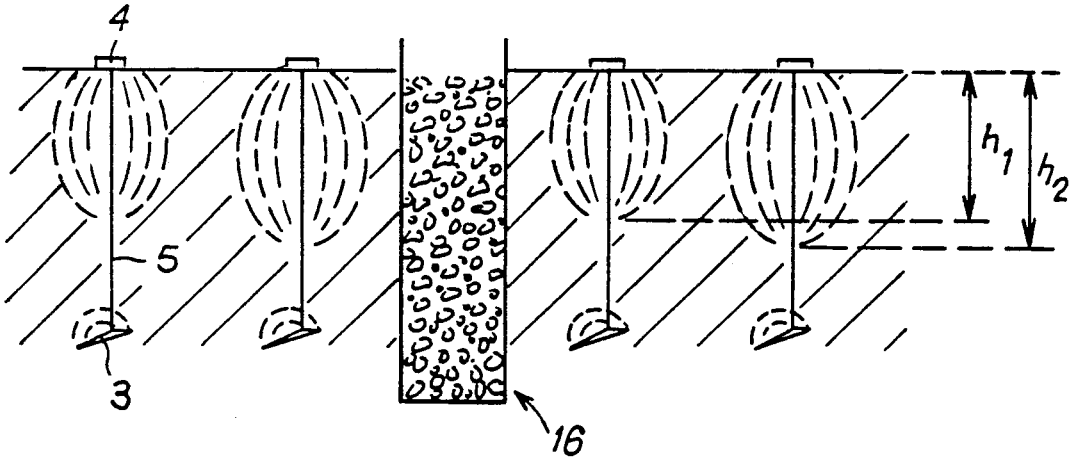
FIG. 8 is a partial vertical section of another embodiment of a shield according to the invention.

FIG. 8 is a schematic vertical section through part of a seismic shield according to the invention.

Said shield comprises in the plane of section or near it, four pre-stressed masses 3.4.5 identical to the mass shown in FIG. 2. The heights of these masses and the heights $H_1$. $H_2$ of the compressed zones advantageously vary from one mass to the other.

The effect of the compression of the ground is that the masses have a rigidity greater than that of the ground.

The shield further comprises in the plane of section an island 16 which is identical to island 10 of FIG. 6 or to island 13 of FIG. 7. This island comprises a vertical bore or well filled with a pulverulent or granular material, i.e. a divided material whose grains have little coherence between one another.

The island 16 presents a rigidity less than that of the ground.

FIGS. 6, 7 and 8 show preferred embodiments of seismic shields according to the invention which comprise both localized pre-stressed masses 3.4.5 or equivalent compacted or concrete masses, which present a rigidity greater than that of the ground, and islands 10.13.16 which are vertical wells or bores filled with a loose material having a high void index, composed of grains with no cohesion between one another, which islands present a rigidity less than that of the ground.

The extent of a seismic shield according to the invention essentially depends on the type of work to be protected and the nature of the ground on which this work is built. A ratio must be respected between the greatest width B of the area of the work and the maximum depth of the anchoring means 3 of the pre-stressed masses or of the wells or bores. In general, the depths of the anchoring means or of the wells or bores are equal to B. B/2. B/4 and B/8.

The dimensions of the shield depend on the dimensions of the work.

The shield projects on either side of the work by a width at least equal to the largest width B of the work.

The anchoring means and wells may be made around the work equally well in a so-called star-like arrangement, be distributed over substantially concentric circumferences, or may be aligned in several rows in a so-called comb arrangement, upstream of the work with respect to the presumed direction of the seismic wave.

What is claimed is:

1. A seismic shield for providing anti-seismic protection for a civil engineering work from the destructive effects of earthquakes, comprising a plurality of individual islands presenting mechanical properties different from those of the ground in order to attenuate the seismic surface waves, said individual islands which are implanted in the ground around said work, each individual island comprises a ground compressed between an anchoring means which is driven in the ground to a depth of between 5 m and 30 m and a sole which is placed on the surface of the ground and which is connected to said anchoring means by a connecting means under tension.

2. The seismic shield of claim 1, further comprising cast walls buried in the ground on at least one side of said compressed ground, said wall being buried to a depth of between 5 m and 30 m.

3. The seismic shield of claim 1, further comprising at least a block of concrete mass, said block being buried to a depth of between 5 and 30 m.

4. The seismic shield of claim 1, wherein each individual island comprises two masses of ground compressed between 5 and 30 m, each with a sole which is placed on the surface of the ground and which is connected to said anchoring means by a connecting means under tension and further comprises a block of concrete cast in the ground between said compressed masses, said block being buried to a depth of between 5 m and 30 m.

5. The seismic shield of claim 1, further comprising blocks of rock piled in wells which are formed in the ground on at least one side of said compressed mass, said walls being formed to a depth of between 5 m and 30 m.

6. The seismic shield of claim 1, further comprising vertical bores or wells presenting a height of between 5 m and 30 m and which contain a piping made of an elastomeric or visco-elastic material filled with a granular or pulverulent material, said bores or wells being formed in the ground on, at least, one side of said compressed mass.

7. The seismic shield of claim 1, further comprising a vertical bore or well which is filled with stacked tires and a granular or pulverulent material filling the remaining space in said bore or well, said bore or well being formed in the ground on at least one side of said compressed mass and to a depth of between 5 and 30 m.

8. The seismic shield of claim 1, wherein the distance between the individual islands is included between three times and five times the largest width of each island.

* * * * *